US009546809B2

(12) United States Patent
Junge

(10) Patent No.: US 9,546,809 B2
(45) Date of Patent: Jan. 17, 2017

(54) REFRIGERATOR APPLIANCE

(71) Applicant: General Electric Company, Schenectady, NY (US)

(72) Inventor: Brent Alden Junge, Evansville, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 448 days.

(21) Appl. No.: 14/096,487

(22) Filed: Dec. 4, 2013

(65) Prior Publication Data

US 2015/0153093 A1 Jun. 4, 2015

(51) Int. Cl.
*F25D 21/04* (2006.01)
*F25D 23/02* (2006.01)

(52) U.S. Cl.
CPC ..... *F25D 21/04* (2013.01); *F25D 23/02* (2013.01); *F25D 2323/021* (2013.01)

(58) Field of Classification Search
CPC ..... F25D 21/04; F25D 23/02; F25D 23/061; F25D 17/062; F25D 17/08
USPC ..... 312/401, 405, 406, 407; 62/150, 419
See application file for complete search history.

(56) References Cited

U.S. PATENT DOCUMENTS 3,918,269 A * 11/1975 Summers ..... F25D 17/065 62/180
4,009,586 A * 3/1977 Skvarenina ..... F25D 21/04 248/596
4,777,806 A * 10/1988 Perez ..... A47F 3/0447 62/256
6,155,060 A 12/2000 Parkman
7,856,845 B2 * 12/2010 Fotiadis ..... F25D 17/062 62/407
2002/0104325 A1 * 8/2002 Mandel ..... F25D 17/042 62/187
2005/0178139 A1 * 8/2005 Kim ..... F25D 21/04 62/277
2006/0260345 A1 * 11/2006 Coulter ..... F25D 11/02 62/340
2007/0107452 A1 * 5/2007 Kim ..... F25D 17/042 62/264
2009/0293501 A1 * 12/2009 Kulkarni ..... F25C 5/005 62/3.63
2012/0023990 A1 * 2/2012 Nelson ..... F24H 4/04 62/238.7

(Continued)

FOREIGN PATENT DOCUMENTS

JP 2005-221193 A 8/2005
WO WO 2006/087690 * 8/2006
WO WO 2009/109022 9/2009

*Primary Examiner* — James O Hansen
(74) *Attorney, Agent, or Firm* — Dority & Manning, P.A.

(57) ABSTRACT

Refrigerator appliances are provided. A refrigerator appliance includes a cabinet defining a fresh food chamber and a freezer chamber. The refrigerator appliance further includes a fresh food door rotatably hinged to the cabinet for accessing the fresh food chamber, the door comprising an inner surface, an outer surface and a side surface extending between the inner surface and the outer surface. The refrigerator appliance further includes a freezer door connected to the cabinet for accessing the freezer chamber. The refrigerator appliance further includes a mullion, the mullion comprising an outer surface, and a fan mounted within one of the mullion, the fresh food door, or the freezer door, the fan configured to flow ambient air across the mullion.

7 Claims, 7 Drawing Sheets

(56) References Cited

U.S. PATENT DOCUMENTS

2013/0119846 A1* 5/2013 Seo ..... F25D 23/028
312/404
2015/0107285 A1* 4/2015 Mitchell ..... F25D 23/04
62/186

* cited by examiner

REFRIGERATOR APPLIANCE

FIELD OF THE INVENTION

The present disclosure related generally to refrigerator appliances, and more particularly to apparatus for reducing external condensation on refrigerator appliance components.

BACKGROUND OF THE INVENTION

Generally, refrigerator appliances include a cabinet that defines a fresh food chamber for receipt of food items for storage. Many refrigerator appliances further include one or more freezer chambers for receipt of food items for freezing and storage. Various mullions typically divide the various chambers. For example, a stationary mullion can be disposed between the fresh food chamber and freezer chamber. In refrigerator appliances with multiple freezer chambers, a stationary mullion can be disposed between the freezer chambers. In "french door" style refrigerator appliances, an articulating mullion can be mounted to one of the fresh food chamber doors and positioned between the fresh food chamber doors when closed.

One issue with many known refrigerator appliances is the appearance of condensation on various exterior components thereof. Of particular concern is the appearance of condensation on mullions. Such condensation generally occurs when the surface temperature of the exterior component, such as the mullion, is below the dew point of the room in which the refrigerator appliance is located.

Various attempts to reduce such condensation have been made. For example, electric heaters have been embedded in the various components, such as the mullions, to heat the mullions and reduce condensation. However, the use of such heaters increases the energy use of the associated refrigerator appliance. Additionally, such electric heaters and associated components, such as humidity sensors, can increase the cost and the complexity of wiring of the associated refrigerator appliance.

Accordingly, improved refrigerator appliances are desired. In particular, improved apparatus for reducing mullion condensation which are cost-effective and energy efficient would be advantageous.

BRIEF DESCRIPTION OF THE INVENTION

Additional aspects and advantages of the invention will be set forth in part in the following description, or may be apparent from the description, or may be learned through practice of the invention.

In accordance with one embodiment, a refrigerator appliance is provided. The refrigerator appliance includes a cabinet defining a fresh food chamber and a freezer chamber. The refrigerator appliance further includes a fresh food door rotatably hinged to the cabinet for accessing the fresh food chamber, the door comprising an inner surface, an outer surface and a side surface extending between the inner surface and the outer surface. The refrigerator appliance further includes a freezer door connected to the cabinet for accessing the freezer chamber. The refrigerator appliance further includes a mullion, the mullion comprising an outer surface, and a fan mounted within one of the mullion, the fresh food door, or the freezer door, the fan configured to flow ambient air across the mullion.

In accordance with another embodiment, a refrigerator appliance is provided. The refrigerator appliance includes a cabinet defining a fresh food chamber and a freezer chamber.

The refrigerator appliance further includes a fresh food door rotatably hinged to the cabinet for accessing the fresh food chamber, the door comprising an inner surface, an outer surface and a side surface extending between the inner surface and the outer surface. The refrigerator appliance further includes a freezer door connected to the cabinet for accessing the freezer chamber. The refrigerator appliance further includes a mullion, the mullion comprising an outer surface, and a duct disposed within the mullion, the duct defining an inlet, an outlet, and a passage extending between the inlet and the outlet. The refrigerator appliance further includes a fan mounted within the mullion, the fan configured to flow ambient air through the passage.

In accordance with another embodiment, a refrigerator appliance is provided. The refrigerator appliance includes a cabinet defining a fresh food chamber and a freezer chamber. The refrigerator appliance further includes a fresh food door rotatably hinged to the cabinet for accessing the fresh food chamber, the door comprising an inner surface, an outer surface and a side surface extending between the inner surface and the outer surface. The refrigerator appliance further includes a freezer door connected to the cabinet for accessing the freezer chamber. The refrigerator appliance further includes a mullion, the mullion comprising an outer surface, and a fan mounted within one of the mullion, the fresh food door, or the freezer door, the fan configured to flow ambient air across the outer surface of the mullion.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
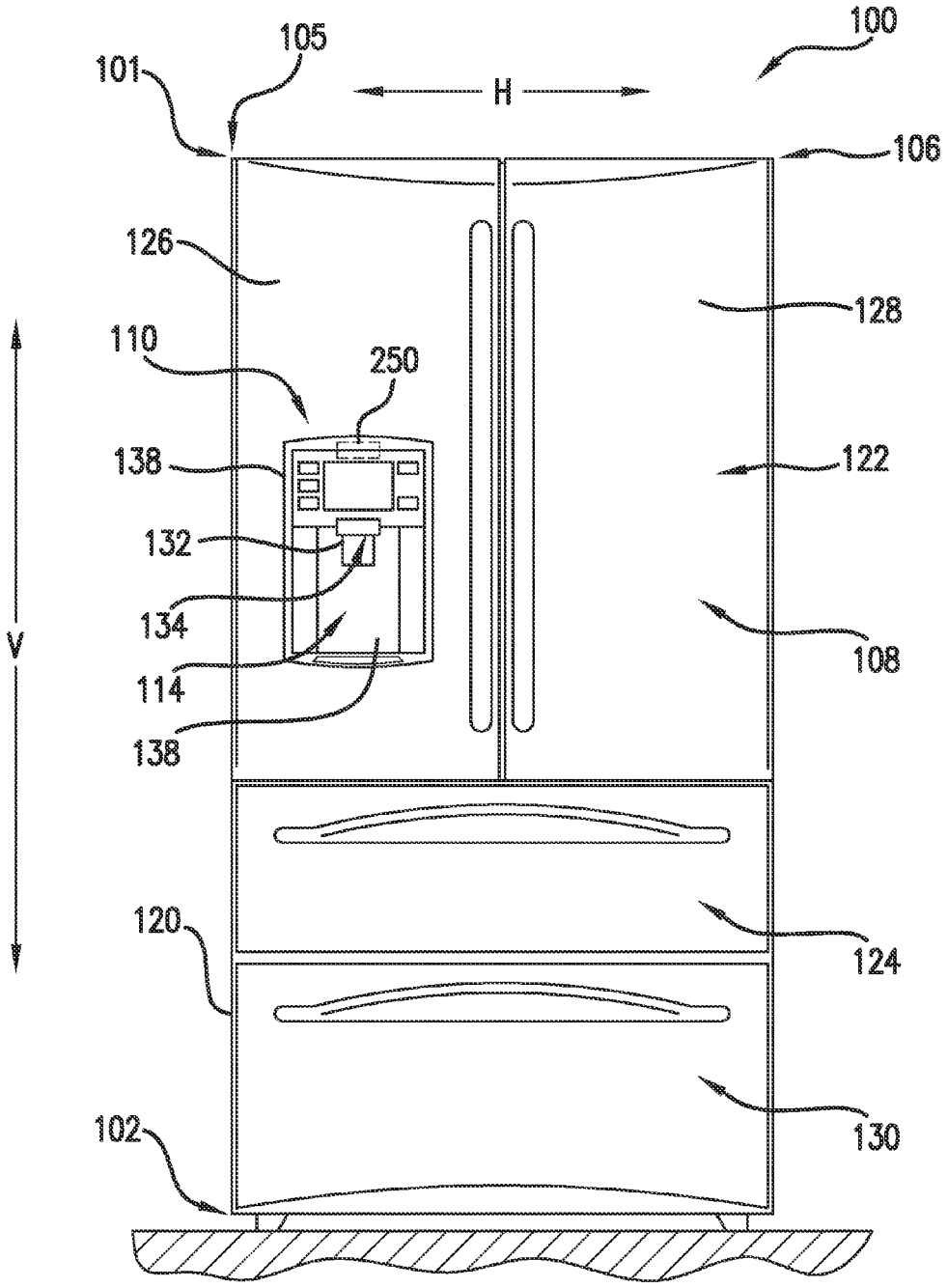
FIG. 1 provides a front view of a refrigerator appliance in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a front view of an exemplary embodiment of a refrigerator appliance 100. Refrigerator appliance 100 extends between a top 101 and a bottom 102 along a vertical direction V. Refrigerator appliance 100 also extends between a first side 105 and a second side 106 along a horizontal direction H. Further, refrigerator appliance 100 extends between a front 108 and a back 109 along a transverse direction T, which may be defined perpendicular to the vertical and horizontal directions V, H.

Refrigerator appliance 100 includes a cabinet or housing 120 defining a fresh food chamber 122 and one or more freezer chambers, such as first freezer chamber 124 and second freezer chamber 125, which may be arranged below the fresh food chamber 122 on the vertical direction V. As such, refrigerator appliance 100 may generally be referred to as a bottom mount refrigerator. In the exemplary embodiment, housing 120 also defines a mechanical compartment (not shown) for receipt of a sealed cooling system (not shown). Using the teachings disclosed herein, one of skill in the art will understand that the present invention can be used with other types of refrigerators (e.g., side-by-sides) or a top freezer appliance as well. Consequently, the description set forth herein is for illustrative purposes only and is not intended to limit the invention in any aspect.

Refrigerator doors 126 are rotatably hinged to an edge of housing 120 for accessing fresh food chamber 122. For example, upper and lower hinges may couple each door 126 to the housing 120. It should be noted that while two doors 126 in a "french door" configuration are illustrated, any suitable arrangement of doors utilizing one, two or more doors is within the scope and spirit of the present disclosure. Freezer doors, such as first freezer door 130 and second freezer door 131, are arranged below refrigerator doors 126 for accessing freezer chamber, such as first and second freezer chambers 124, 125, respectively. In the exemplary embodiment, freezer doors 130, 131 are coupled to freezer drawers (not shown) slidably coupled within freezer chambers 124, 125. Such drawers are thus generally "pull-out" drawers in that they can be manually moved into and out of the freezer chambers 124, 125 on suitable slide mechanisms.

Figure 2:
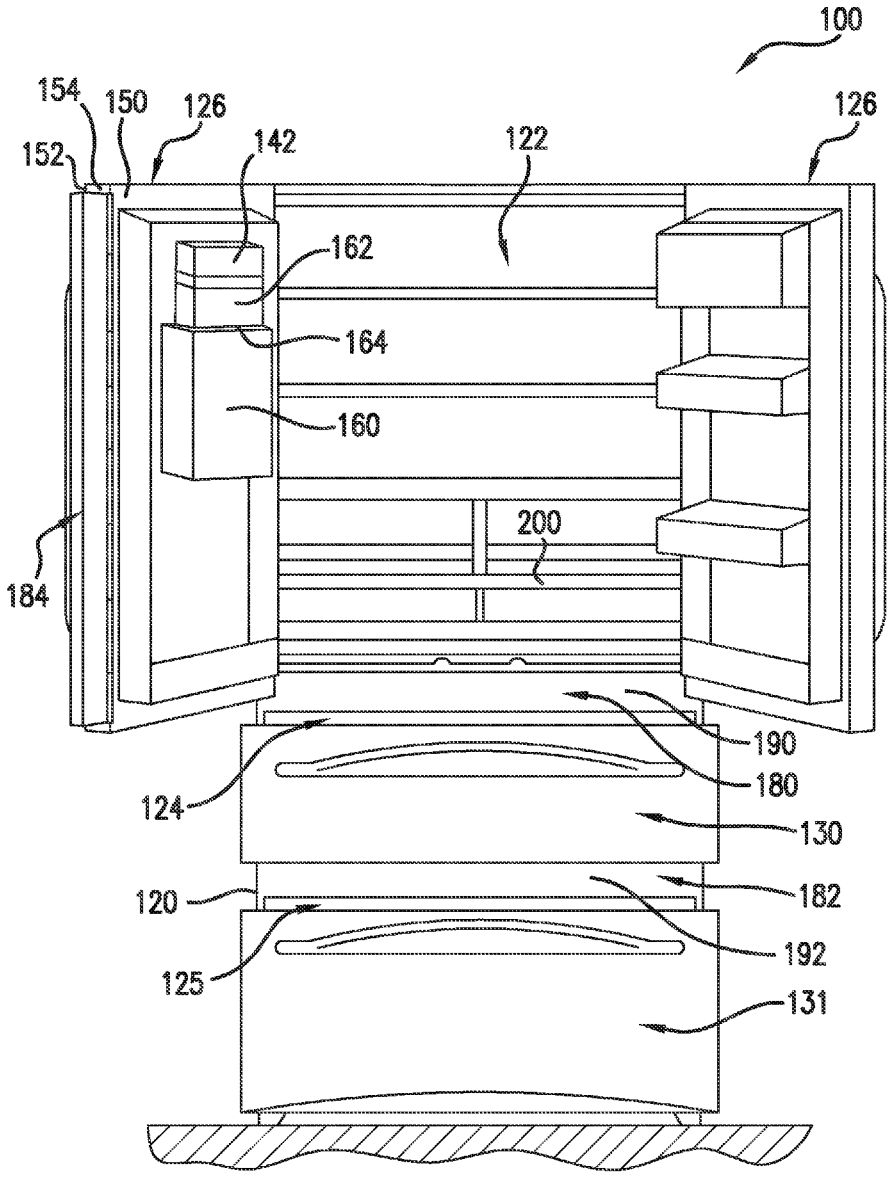
FIG. 2 provides a front view of the refrigerator appliance of FIG. 1 with refrigerator doors of the refrigerator appliance shown in an open configuration to reveal a fresh food chamber and freezer chambers of the refrigerator appliance.

FIG. 2 is a perspective view of refrigerator appliance 100 having refrigerator doors 126 in an open position to reveal the interior of the fresh food chamber 122. Additionally, freezer doors 130, 131 are shown in open positions to reveal the interior of the freezer chambers 124, 125.

A door 126 of the refrigerator appliance 100 may include an inner surface 150 and an outer surface 152. The inner surface 150 generally defines the interior of the fresh food chamber 122 when the door 126 is in a closed position as shown in FIG. 1, while the outer surface 152 is generally opposite the inner surface 150 and defines the exterior of the refrigerator appliance. Side surfaces 154 may extend between and connect the inner surface 150 and outer surface 152.

Refrigerator appliance 100 may further include a dispensing assembly 110 for dispensing water and/or ice. Dispensing assembly 110 includes a dispenser 114 positioned on an exterior portion of refrigerator appliance 100. Dispenser 114 includes a discharging outlet 134 for accessing ice and water. A single paddle 132 is mounted below discharging outlet 134 for operating dispenser 114. A user interface panel 136 is provided for controlling the mode of operation. For example, user interface panel 136 includes a water dispensing button (not labeled) and an ice-dispensing button (not labeled) for selecting a desired mode of operation such as crushed or non-crushed ice.

Discharging outlet 134 and paddle 132 are an external part of dispenser 114, and are mounted in a recessed portion 138 defined in an outside surface of refrigerator door 126. Recessed portion 138 is positioned at a predetermined elevation convenient for a user to access ice or water enabling the user to access ice without the need to bend-over and without the need to access freezer chamber 124. In the exemplary embodiment, recessed portion 138 is positioned at a level that approximates the chest level of a user.

Further components of dispensing assembly 110 are illustrated in FIG. 2. Dispensing assembly 110 includes an insulated housing 142 mounted to door 126. Due to the insulation which encloses insulated housing 142, the temperature within insulated housing 142 can be maintained at levels different from the ambient temperature in the surrounding fresh food chamber 122.

The insulated housing 142 is constructed and arranged to operate at a temperature that facilitates producing and storing ice. More particularly, the insulated housing 142 contains an ice maker for creating ice and feeding the same to an ice container 160, both of which may be mounted on refrigerator door 126. As illustrated in FIG. 2, container 160 is placed at a vertical position on refrigerator door 126 that will allow for the receipt of ice from a discharge opening 162 located along a bottom edge 164 of insulated housing 142.

Referring still to FIG. 2, various mullions may be provided in refrigerator appliance 100. Mullions generally divide the various chambers of the refrigerator appliance 100 and/or prevent leakage therefrom. For example, a stationary mullion 180 may extend and be disposed between the fresh food chamber 122 and a freezer chamber, such as first freezer chamber 124. A stationary mullion 182 may additionally extend and be disposed between the first freezer chamber 124 and second freezer chamber 125. Such mullions 180, 182 may generally extend along the horizontal direction H between the various chambers, as shown. Additionally, an articulating mullion 184 may extend between the doors 126. Articulating mullion 184 may be connected to one of the doors 126. For example, articulating mullion 184 may be rotatably hinged, via hinges 186, to a door 126. Articulating mullion 184 may generally extend along the vertical direction V, as shown. When in the closed position, articulating mullion 184 may generally be positioned between the doors 126 (along the horizontal direction H) and may prevent leakage between the doors 126.

Each mullion may generally include a body defining various surfaces, including an outer surface which may be the surface facing a user accessing the refrigerator appliance 100 (such as when in the closed position). For example, mullion 180 may include an outer surface 190, mullion 182 may include an outer surface 192, and mullion 194 may include an outer surface 194.

Referring now to FIGS. 3 through 7, the present disclosure is further directed to apparatus for reducing condensation on mullions 180, 182, 184, such as on outer surfaces 190, 192, 194 thereof. For example and as illustrated, a fan 200 may be mounted within various locations on the refrigerator appliance 100, such as a mullion 180, 182, 184, a refrigerator door 126, or a freezer door 130, 131. Such fan 200 may be configured to flow ambient air across the mullion, such as generally along a longitudinal axis of the mullion. Reference arrow 202 provides exemplary flow directions for ambient air according to various embodiments of the present disclosure. For example, ambient air may be flowed by fan 200 generally along the horizontal direction H with respect to mullions 180, 182 or along the vertical direction V with respect to mullion 184.

Additionally, in exemplary embodiments, a duct 210 may be utilized to flow ambient air therethrough. Duct 210 may be disposed within various locations on the refrigerator appliance 100, such as a mullion 180, 182, 184, a refrigerator door 126, or a freezer door 130, 131. Duct 210 may define an inlet 212, an outlet 214, and a passage 216 therebetween. Fan 200 may flow ambient air through the duct 210, such as into the inlet 212, through the passage 216, and out of the outlet 214. In some embodiments, ambient air is flowed across a mullion by being flowed through passage 216, as illustrated for example in FIGS. 3 and 6. In other embodiments, ambient air is flowed through passage 216 and exhausted through outlet 214 towards a mullion, such that the ambient air is then flowed across the outer surface of the mullion, as illustrated for example in FIGS. 4, 5 and 7.

The use of ambient air flowed by fan 200 across such mullions provides a variety of advantages. Ambient air according to the present disclosure is generally air which is exterior to the refrigerator appliance 100 before being flowed across a mullion. Such air is typically warmer than air within refrigerator appliance 100, such as within fresh food chamber 122 or a freezer chamber 124, 125. Thus, the ambient air flowed across a mullion may generally warm the mullion, reducing condensation on the mullion, such as on the outer surface thereof. Further, the use of a fan 200 to flow ambient air uses significantly less energy, provides significant cost savings, and is significantly less complex relative to conventionally known apparatus such as electric heaters.

Figure 3:
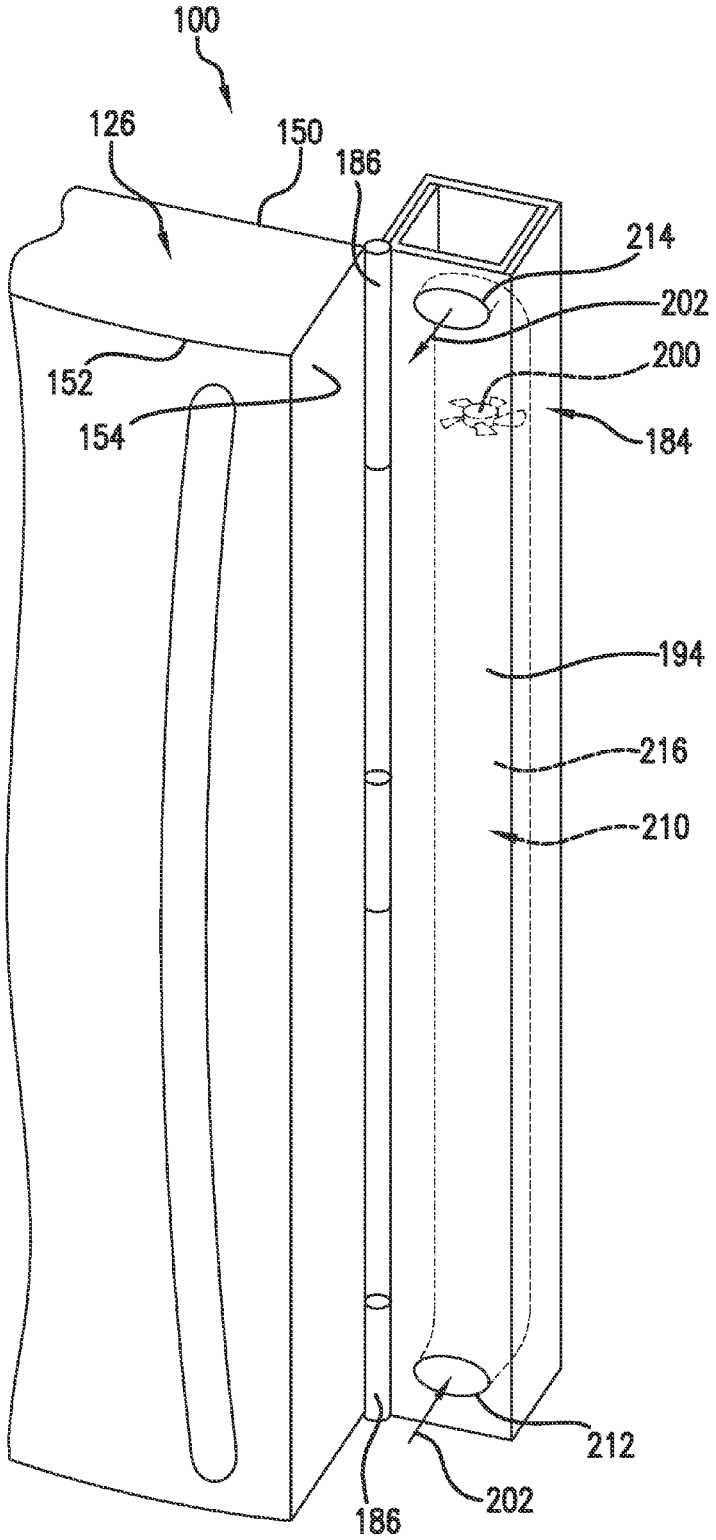
FIG. 3 provides a perspective view of a fresh food door, an articulating mullion, and various condensation reducing components in accordance with one embodiment of the present disclosure.

FIGS. 3 through 7 illustrate various embodiments of refrigerator appliance 100 with fan 200 in various positions. Referring to FIG. 3, for example, fan 200 may be disposed within mullion 184. As illustrated, duct 210 may be disposed within mullion 184, such that inlet 212 and outlet 214 are defined in the outer surface 194 thereof and passage 216 is generally defined within the mullion 184. Duct 210 generally extends along a longitudinal axis of the mullion 184, such as along the vertical direction V. Fan 200 is disposed within the mullion 184, such as at least partially within the passage 216. When operating, the fan 200 flows ambient air through the passage 216. Flowing the ambient air through the passage 216 flows the ambient air across the mullion 184, thus heating the outer surface 194 thereof and reducing condensation thereon.

Figure 4:
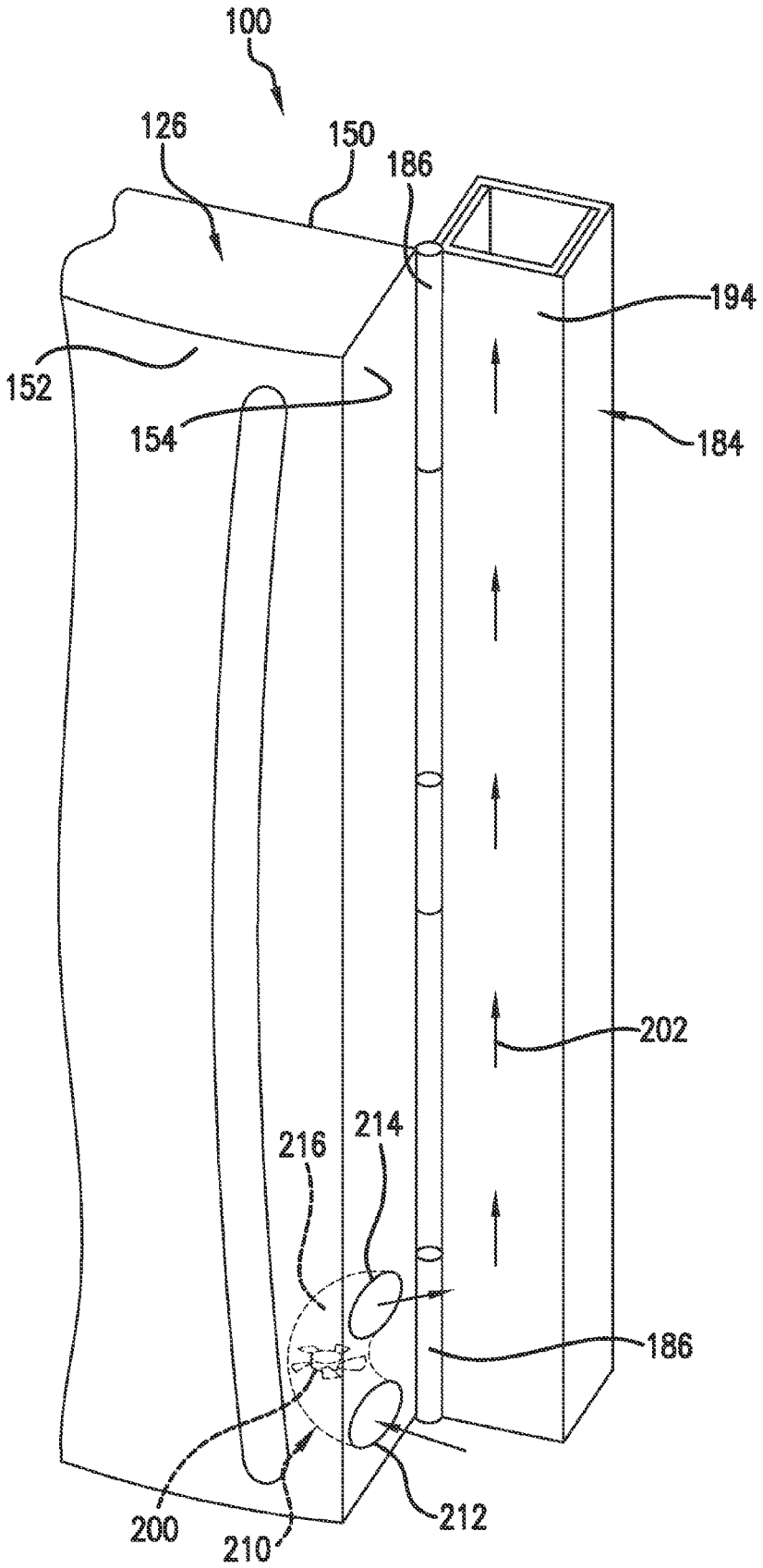
FIG. 4 provides a perspective view of a fresh food door, an articulating mullion, and various condensation reducing components in accordance with another embodiment of the present disclosure.

Referring to FIG. 4, fan 200 may be disposed within door 126. As illustrated, duct 210 may be disposed within door 126, such that such that inlet 212 and outlet 214 are defined in the side surface 154 thereof and passage 216 is generally defined within the door 126. Fan 200 is disposed within the door 126, such as at least partially within the passage 216. Ambient air flowed through the passage 216 may be exhausted through outlet 214, and may be flowed from outlet 214 towards mullion 184 such that the ambient air flows across the outer surface 194 thereof, thus heating the outer surface 194 thereof and reducing condensation thereon.

Figure 5:
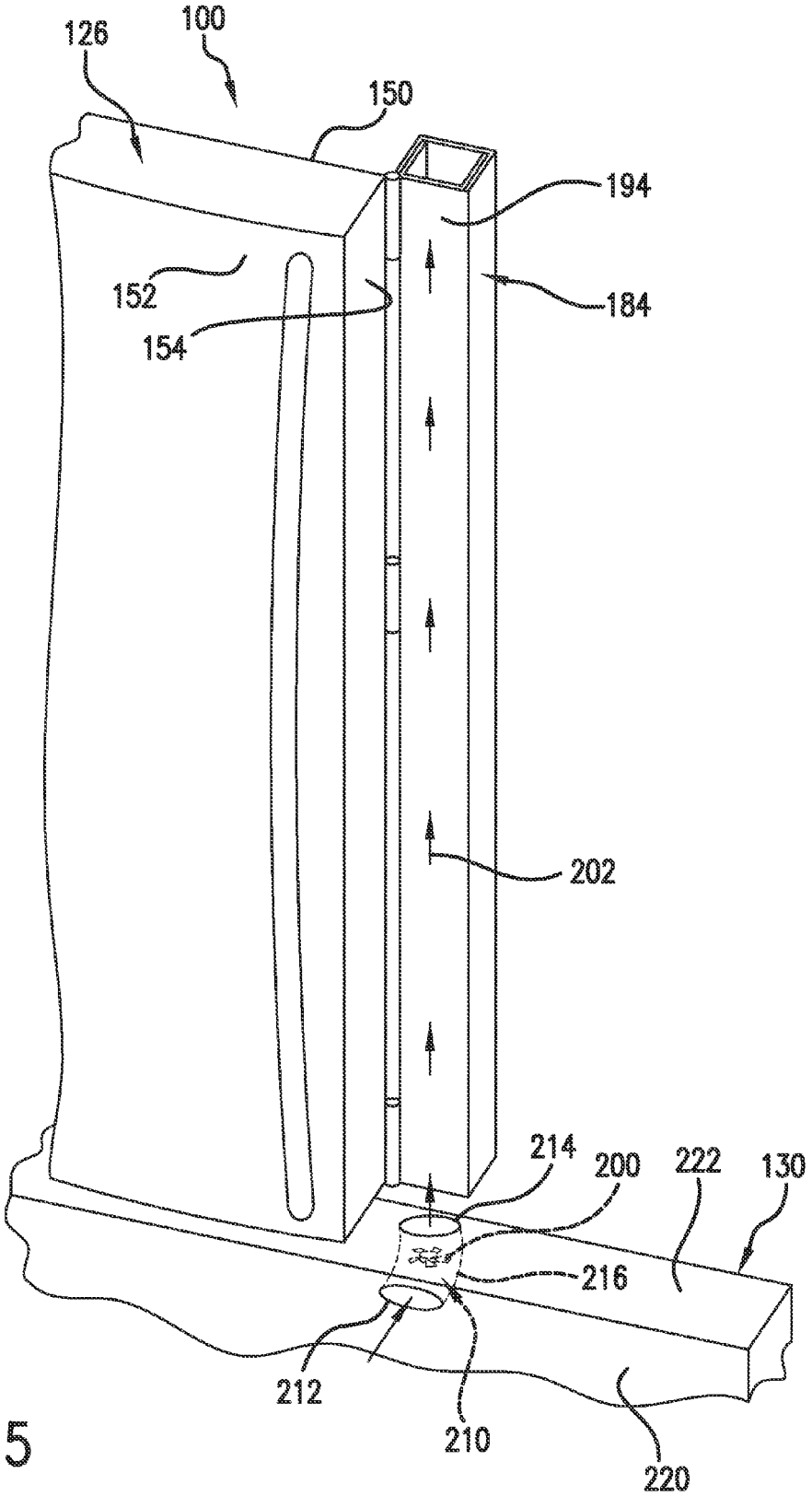
FIG. 5 provides a perspective view of a fresh food door, a freezer door, an articulating mullion, and various condensation reducing components in accordance with one embodiment of the present disclosure.

Referring to FIG. 5, fan 200 may be disposed within door 130. As illustrated, duct 210 may be disposed within door 130. For example, inlet 212 may be defined on a front surface 220 of the door 130, and outlet 214 may be defined on a top surface 222 of the door 130. Passage 216 is generally defined within the door 130. Fan 200 is disposed within the door 130, such as at least partially within the passage 216. Ambient air flowed through the passage 216 may be exhausted through outlet 214, and may be flowed from outlet 214 towards mullion 184 such that the ambient air flows across the outer surface 194 thereof, thus heating the outer surface 194 thereof and reducing condensation thereon.

Figure 6:
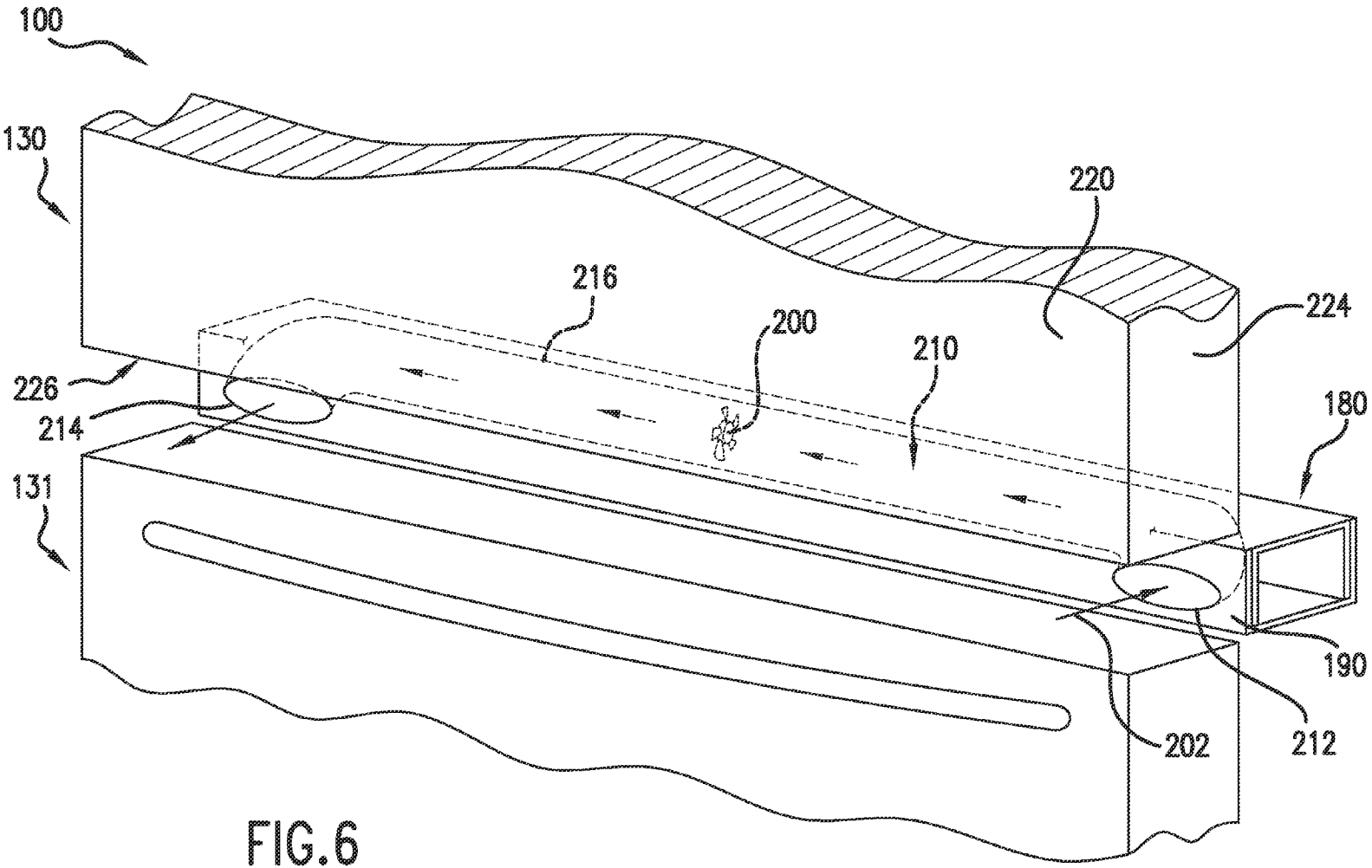
FIG. 6 provides a perspective view of a first freezer door, a second freezer door, a stationary mullion, and various condensation reducing components in accordance with one embodiment of the present disclosure.

Referring to FIG. 6, fan 200 may be disposed within mullion 182. As illustrated, duct 210 may be disposed within mullion 182, such that inlet 212 and outlet 214 are defined in the outer surface 192 thereof and passage 216 is generally defined within the mullion 182. Duct 210 generally extends along a longitudinal axis of the mullion 182, such as along the horizontal direction H. Fan 200 is disposed within the mullion 182, such as at least partially within the passage 216. When operating, the fan 200 flows ambient air through the passage 216. Flowing the ambient air through the passage 216 flows the ambient air across the mullion 182, thus heating the outer surface 192 thereof and reducing condensation thereon.

Figure 7:
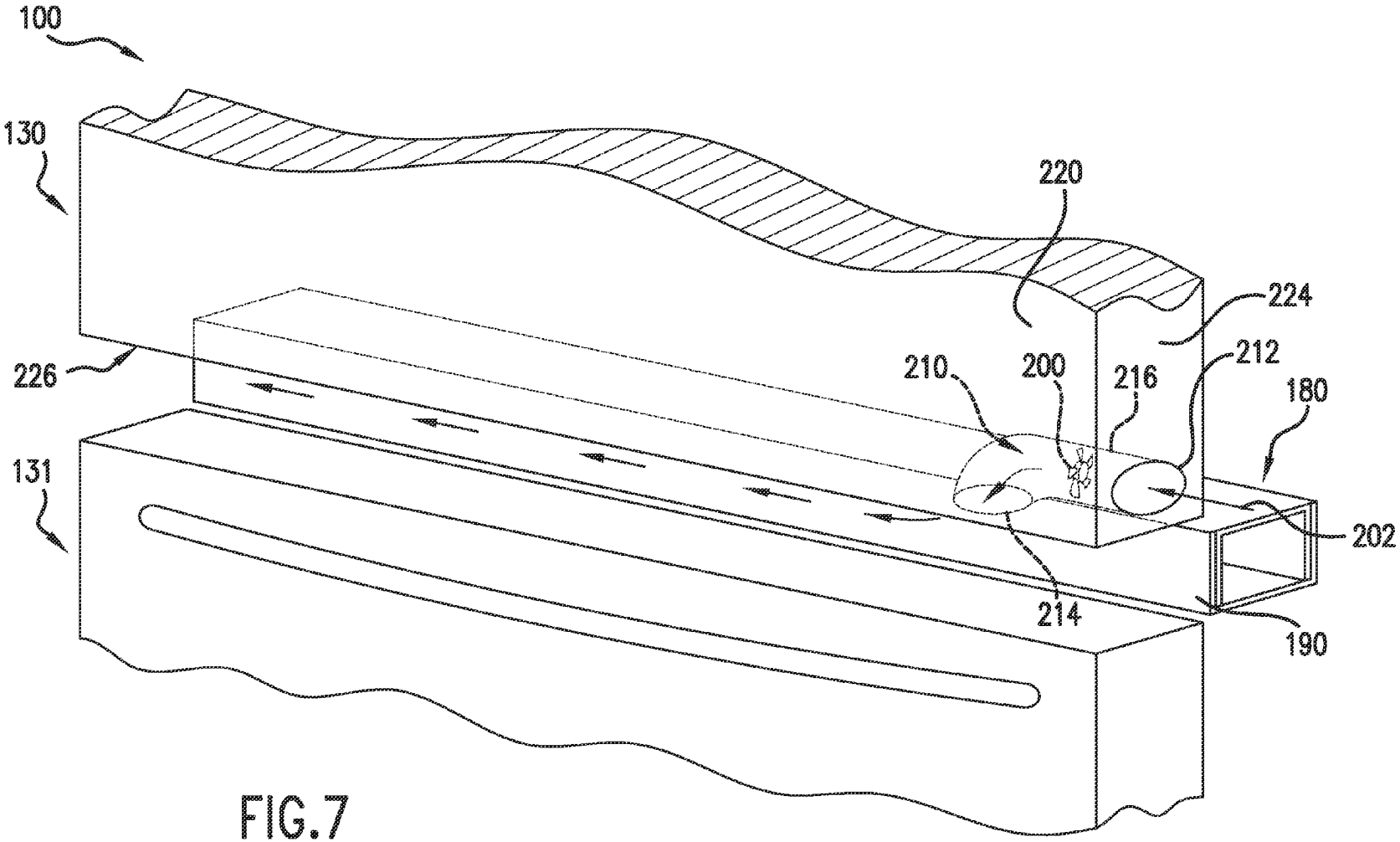
FIG. 7 provides a perspective view of a first freezer door, a second freezer door, a stationary mullion, and various condensation reducing components in accordance with another embodiment of the present disclosure.

Referring to FIG. 7, fan 200 may be disposed within door 130. As illustrated, duct 210 may be disposed within door 130. For example, inlet 212 may be defined on a side surface 224 of the door 130, and outlet 214 may be defined on a bottom surface 226 of the door 130. Passage 216 is generally defined within the door 130. Fan 200 is disposed within the door 130, such as at least partially within the passage 216. Ambient air flowed through the passage 216 may be exhausted through outlet 214, and may be flowed from outlet 214 towards mullion 182 such that the ambient air flows across the outer surface 192 thereof, thus heating the outer surface 192 thereof and reducing condensation thereon.

It should be understood that the present disclosure is not limited to the above disclosed embodiments. For example, fan 200 and duct 210 may be disposed within any suitable component of the refrigerator appliance 100, including mullions 180, 182, 184, doors 126, doors 130, 131, or other suitable components. Duct 210 may include inlet 212 and outlet 214 which are defined in any suitable surface such component such that ambient air is flowed through the duct 210 and flowed in passages 216 across a mullion 180, 182, 184 or flowed from outlet 214 towards and across outer surface 190, 192, 194 of a mullion 180, 182, 184. Still further, it should be understood that ducts 210 are not required for operation of a fan 200 according to the present disclosure. For example, a fan 200 may be disposed within a component, such as one of mullions 180, 182, 184, doors 126, doors 130, 131, or another suitable component, and may blow air directly towards an outer surface 190, 192, 194 of a mullion 180, 182, 184 such that the air flows across the mullion 180, 182, 184.

Operation of the refrigerator appliance 100 can be regulated by a controller 250 that is operatively coupled to user interface panel 136 and/or various other sensors. User interface panel 136 provides selections for user manipulation of the operation of refrigerator appliance 100 such as e.g., selections between whole or crushed ice, chilled water, and/or other various options. In response to user manipulation of the user interface panel 136 or sensor signals, controller 250 may operate various components of the refrigerator appliance 100. Controller 250 may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 250 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 250 may be positioned in a variety of locations throughout refrigerator appliance 100. For example, controller 250 may be located within the user interface panel 136, or may be positioned at any other suitable location within refrigerator appliance 100, such as for example within a fresh food chamber, a freezer door, etc. Input/output ("I/O") signals may be routed between controller 250 and various operational components of refrigerator appliance 100. For example, user interface panel 136 may be in communication with controller 250 via one or more signal lines or shared communication busses.

In some embodiments, controller 250 may be in operable communication with the fan 200, such as through a suitable wireless or wired connection, and may be operable to control the speed of the fan 200. For example, fan 200 may be synced, through controller 250, to the compressor (not shown) of the refrigerator appliance 100. The controller 250 may, for example, operate the fan 200 at a predetermined speed when the compressor is operating, and at a predetermined lesser speed or zero speed (off) when the compressor is not operating. Additionally or alternatively, the controller 250 may operate the fan 200 at any suitable speed based on user input, such as to the user interface panel 136. Controller 250 may, for example, operate fan 200 at certain levels at times when condensation would be likely to form on a mullion, in order to reduce such condensation, while advantageously operating fan 200 at lesser levels when such condensation is not likely to occur.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance, comprising:

a cabinet defining a fresh food chamber and a freezer chamber;

a fresh food door rotatably hinged to the cabinet for accessing the fresh food chamber, the door comprising an inner surface, an outer surface and a side surface extending between the inner surface and the outer surface;

a freezer door connected to the cabinet for accessing the freezer chamber;

a mullion dividing the fresh food chamber along a generally vertical direction, the mullion comprising an outer surface, the mullion being connected to the fresh food door; and a fan mounted within the mullion, the fan configured to flow ambient air across the mullion.

2. The refrigerator appliance of claim 1, further comprising a duct disposed within the one of the mullion, the fresh food door, or the freezer door, the duct defining an inlet, an outlet, and a passage extending between the inlet and the outlet, and wherein the fan flows ambient air through the passage.

3. The refrigerator appliance of claim 2, wherein the duct is disposed within the mullion.

4. The refrigerator appliance of claim 2, wherein flowing the ambient air through the passage flows the ambient air across the mullion.

5. The refrigerator appliance of claim 2, wherein the ambient air flowed through the passage is exhausted through the outlet and flowed across the outer surface of the mullion.

6. The refrigerator appliance of claim 1, further comprising a controller in operable communication with the fan, the controller operable to control a speed of the fan.

7. A refrigerator appliance, comprising:

a cabinet defining a fresh food chamber and a freezer chamber;

a fresh food door rotatably hinged to the cabinet for accessing the fresh food chamber, the door comprising an inner surface, an outer surface and a side surface extending between the inner surface and the outer surface;

a freezer door connected to the cabinet for accessing the freezer chamber;

a mullion dividing the fresh food chamber along a generally vertical direction, the mullion comprising an outer surface, the mullion being connected to the fresh food door;

a duct disposed within the mullion, the duct defining an inlet, an outlet, and a passage extending between the inlet and the outlet;

a fan mounted within the mullion, the fan configured to flow ambient air through the passage.

* * * * *